US007896326B2

(12) United States Patent
Cunningham

(10) Patent No.: US 7,896,326 B2
(45) Date of Patent: Mar. 1, 2011

(54) JIG FOR MOUNTING OBJECTS ON A WALL OR CEILING

(76) Inventor: Robert E. Cunningham, Tucson, AZ (US)

( * ) Notice: Subject to any disclaimer, the term of this patent is extended or adjusted under 35 U.S.C. 154(b) by 374 days.

(21) Appl. No.: 11/773,210

(22) Filed: Jul. 3, 2007

(65) Prior Publication Data

US 2009/0008849 A1 Jan. 8, 2009

(51) Int. Cl.
*B25B 11/00* (2006.01)
*B23Q 3/00* (2006.01)

(52) U.S. Cl. ..... 269/79; 29/281.1; 269/296

(58) Field of Classification Search ..... 29/281.1, 29/249; 269/79, 296, 139, 16; 248/244, 248/235, 241, 243, 250, 295.11
See application file for complete search history.

(56) References Cited

U.S. PATENT DOCUMENTS

| | | | | |
|---|---|---|---|---|
| 3,420,488 | A * | 1/1969 | Sisler | 248/291.1 |
| 3,433,443 | A * | 3/1969 | Beeson et al. | 248/214 |
| 4,128,234 | A | 12/1978 | McKee | |
| 4,455,756 | A | 6/1984 | Greene | |
| 4,485,561 | A | 12/1984 | Hopkins, Sr. | |
| 4,715,760 | A | 12/1987 | Browning | |
| 4,955,592 | A | 9/1990 | Brennan, Sr. | |
| 4,981,288 | A | 1/1991 | Goss | |
| 5,160,126 | A | 11/1992 | Atkinson | |
| 5,275,390 | A | 1/1994 | Brennan | |
| 5,303,899 | A | 4/1994 | Palya | |
| 5,645,272 | A | 7/1997 | Brennan, Sr. | |
| 5,775,655 | A * | 7/1998 | Schmeets | 248/240 |
| 6,026,584 | A | 2/2000 | Wegman | |
| 6,026,932 | A * | 2/2000 | Comp | 182/150 |
| 6,070,841 | A * | 6/2000 | Robinson | 248/220.43 |
| 6,322,062 | B1 | 11/2001 | Conn et al. | |
| 6,467,236 | B1 * | 10/2002 | Schlegel | 52/749.1 |
| 6,581,921 | B2 | 6/2003 | Griggs | |
| 6,739,065 | B2 | 5/2004 | Hofmeister et al. | |
| 6,863,270 | B2 | 3/2005 | Bartley, Jr. | |
| 7,155,840 | B1 | 1/2007 | Carbonaro | |
| 2002/0171189 | A1 | 11/2002 | Griggs | |
| 2003/0051363 | A1 | 3/2003 | Hofmeister et al. | |
| 2003/0178759 | A1 | 9/2003 | Bartley, Jr. | |
| 2004/0098875 | A1 | 5/2004 | Gould | |
| 2005/0217040 | A1 * | 10/2005 | Jackson | 14/77.1 |
| 2009/0008849 | A1 * | 1/2009 | Cunningham | 269/79 |

FOREIGN PATENT DOCUMENTS

| | | |
|---|---|---|
| WO | 03099520 | 12/2003 |

* cited by examiner

*Primary Examiner*—Lee D Wilson
(74) *Attorney, Agent, or Firm*—Quarles & Brady LLP; Gavin J. Milczarek-Desai

(57) ABSTRACT

An article, method, and kit for holding an object in place on a wall that include a jig with a support member and a platform member that is coupled to, and extends perpendicularly from, the support member. The support member has a top end including a portion adapted to be positioned behind a wall-facing surface of an object placed upon the platform member and an opening that is adapted to removably engage a coupling device on or in a wall such that the support member is disposed in a substantially vertical hanging position upon the wall. The jig may further include a brace member that forms a triangle by connecting a lower side of the platform member to the support member.

4 Claims, 2 Drawing Sheets

JIG FOR MOUNTING OBJECTS ON A WALL OR CEILING

BACKGROUND OF THE INVENTION

1. Field of the Invention

The invention relates generally to supporting items on a wall such that attachment to the wall can take place and more particularly to a jig or holder that is especially useful for cabinet installation.

2. Description of the Related Art

In the construction industry, walls and ceilings can be at least partially covered with shelves, cabinets, and the like. Previously, items such as cabinets are attached to a wall using a crew of workers who would manually lift a cabinet and hold it in place while it is secured to the wall. Shelves, hanging storage areas, and other objects typically are secured against wall framing by nailing, screwing, adhesive bonding or by a combination of fastening techniques to achieve permanent installation.

Because of the time involved in achieving proper installation, as well as the size and weight of the cabinet or other object involved, the installation procedure oftentimes requires at least three people, particularly where each item must be retained in an elevated position by two people while installation is achieved by the third person. The installation is complicated further, and presents a potential safety risk, by the typical use of step ladders, planks of wood, or other movable platforms in order to place the object in its ultimate position. In many instances, such moveable platforms an not meant to bear the weight of, or provide stability to, the object to be mounted and/or lead to imprecise installation in that the object is not kept level. Such complications make what can be a very long and strenuous process even more time-consuming and laborious.

Others previously have sought to improve the way in which particularly heavy items were mounted to walls or ceilings by using jacks that lift and hold the item in place during installation. For example, U.S. Pat. No. 6,581,921 by Griggs discloses a conventional hydraulic jack for supporting a cabinet during fastening to a wall stud or ceiling joist. While such a device may be suitable for its intended purpose, the weight, cost and amount of manual operation involved are relatively high.

In addition, brackets or braces that support a cabinet from the floor (or a countertop/vanity area) are in widespread use. For example, U.S. Pat. No. 4,981,288 by Goss discloses an adjustable support bracket that provides a platform for holding a cabinet. The arm and leg of Goss' bracket use the floor or a countertop surface to support the platform. For strength and stability reasons, Goss' bracket is shown to be clamped in place. Of course, this adds an additional part and thereby complexity to the cabinet mounting process.

Thus, it continues to be desirable for there to be a support device or jig that is easily adjusted to a variety of lengths, is strong and easy to position, yet compact and securely fastened to a wall, to provide an improved device and method for supporting objects such as cabinets during installation.

SUMMARY OF THE INVENTION

The invention relates in general to an article, kit, and method for holding an object, such as a cabinet, in place so that the object can be mounted or installed on a wall or ceiling. The article, referred to herein as a jig, includes a support member and a platform member. The support member has a top end and a bottom end, wherein a portion of the top end is adapted to be positioned behind a wall-facing surface of the object and further includes an opening that is adapted to removably engage a coupling device on or in the wall such that the support member is disposed in a substantially vertical hanging position upon the wall. The platform member is coupled to, and extends perpendicularly from, the support member to thereby provide a platform for supporting the object.

Preferably, the jig further including a brace member that forms a triangle by connecting a lower side of the platform member to the support member. In some embodiments, the brace member is positionally adjustable along the support member to provide a tilting action for the platform member. In this regard, the brace member preferably is hingedly connected to the platform member.

In one aspect of the invention, the platform member and the brace member are positionally adjustable along the support member. Thus, in some embodiments of the invention, the support member includes a track within which the platform member and the brace member are adapted to slide along the support member. Preferably, a fastener or turn knob releasably locks the platform member and brace member in a given position once the user is ready to place the object upon the platform member.

In another aspect of the invention, a kit for installing an object in place on a wall is provided. A typical kit includes, but is not limited to, a plurality of jigs, with each of the jigs including a support member having a top end and a bottom end and a platform member coupled to, and extending perpendicularly from, the support member. The kit of some embodiments further includes a slat adapted to engage at least two jigs to thereby form a bridge there between for supporting the object to be installed. Preferably, the slat is adjustable in length to engage jigs set at a variety of distances from each other.

Another aspect of the invention involves a method for supporting an object during a mounting or installation procedure. Preferably, the method includes the steps of: (1) placing the opening of a jig of the invention upon a coupling device (such a nail or screw) in or on a wall such that the jig is in a substantially vertical hanging position on the wall; (2) positioning the object upon the platform member of the jig such that a portion of the top end of the support member is behind the wall-facing surface of the object; (3) installing the object upon the wall or ceiling; and (4) removing the jig by applying an upward force to the support member to disengage the jig opening from the coupling device.

In one aspect of the method of the invention, a jig is provided that further includes a brace member that forms a triangle by connecting a lower side of the platform member to the support member. In another aspect of the method, the provided jig includes a platform member and a brace member that are positionally adjustable along the support member such that the platform member and the brace member are lowered prior to step (d).

Thus, the invention provides a new and improved device, kit, and method for assisting a user in holding an object in place during various installation procedures.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

Figure 1:
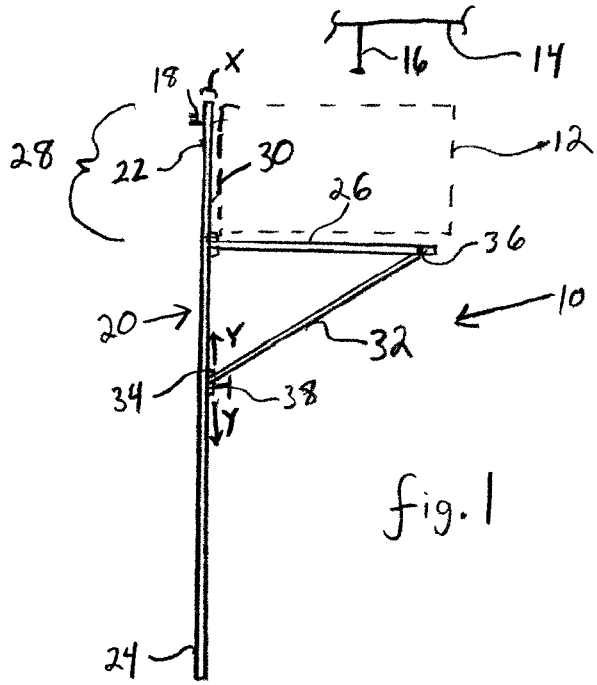
FIG. 1 is side elevational view of an embodiment of the invention.

Referring to FIG. 1, the numeral 10 identifies an article in accordance with the invention for holding an object, such as a cabinet 12 (shown in phantom line). The article or jig 10 helps to support the cabinet 12 in a level position such the user(s) can focus on mounting or installing the cabinet on a wall (shown in FIG. 3) or ceiling 14 (e.g., hanging a drop-down storage cabinet on bolt 16).

The jig 10 includes a support member 20 having a top end 22, a bottom end 24, and a platform member 26 coupled to, and extending perpendicularly from, the support member 20. A portion 28 of the top end 22 is adapted to be positioned behind a wall-facing surface 30 of the cabinet 12. Portion 28 of top end 22 includes an opening (shown in FIG. 2) that is adapted to removably engage a coupling device 18 on or in a wall such that the support member is disposed in a substantially vertical hanging position upon the wall.

Preferably, the portion 28 has a thickness X that enables the top end 22 to easily fit behind even an object that will be mounted flush against a wall. In this regard, the portion 28 preferably will be flat and no more than about ⅛ inch or less in thickness. Moreover, the coupling member 18 may be a hook, nail, screw, or other implement that will support the weight of the object being installed through engagement with the opening on the jig 10.

Also preferably, jig 10 further includes a brace member 32 that forms a triangle by connecting a lower side of platform member 26 to support member 20. A slide member 34 may be utilized to impart adjustability to the brace member 32 along the support member as shown by arrows Y. In this regard, brace member 32 preferably is connected by a hinge 36 to platform member 26 to enable the platform member to be dropped or raised in a tilting fashion, which assists in removing the jig upon completion of the installation as discussed further below. A fastener or turn knob 38 releasably locks the brace member 26 in a position as shown. However, it also is possible to provide a jig in which the positions of the brace and/or platform members are fixedly attached to the support member or which are positioned at stops (not shown) along the support member, rather than being clamped to the support member by a fastener or turn knob.

Figure 2:
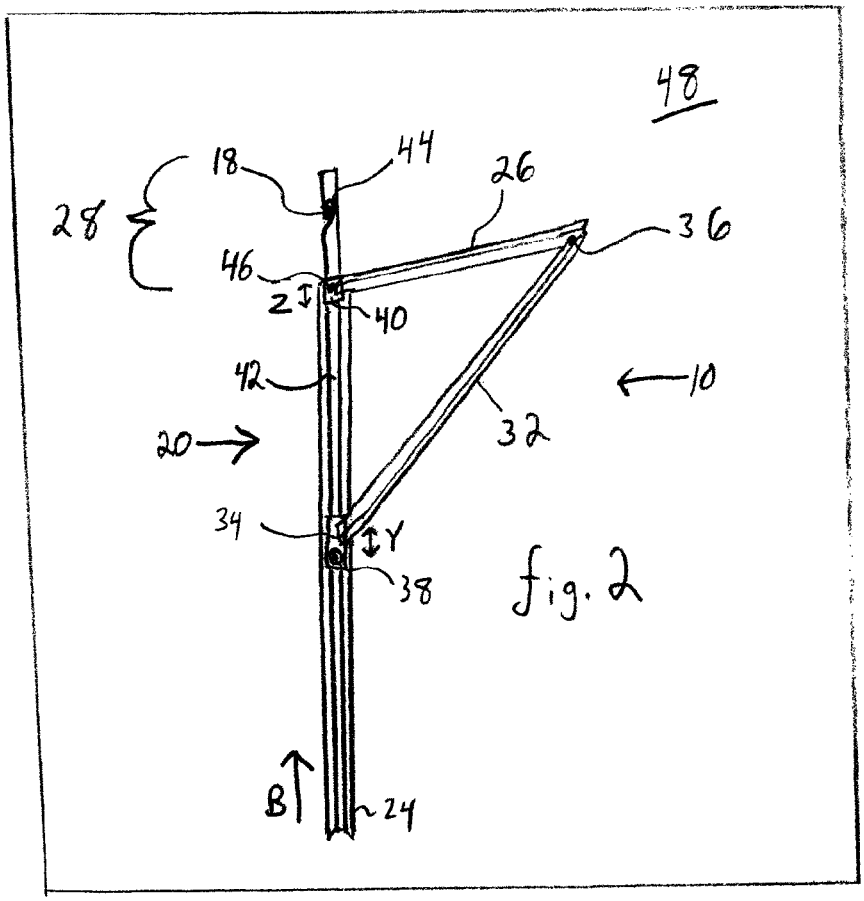
FIG. 2 illustrates in perspective view the embodiment of FIG. 1.

Turning to FIG. 2, which is a slightly enlarged perspective view of the embodiment illustrated in FIG. 1, jig 10 is more clearly shown to include both a platform member 26 and a brace member 32 that are positionally adjustable (indicated by arrows Y and Z) along the support member 20 via slides 34 and 40. Turn knob 38 on slide 34 or screw 46 on slide 40 are used to reversibly lock the platform and brace members in place on support member 20. The slides 34 and 40 preferably are disposed within the track 42 located upon support member 20. In this regard, the track and slide arrangement of a common sliding door may be utilized.

Portion 28 of top end 22 includes an opening 44 that is adapted to removably engage a coupling device 18 on or in a wall 48 such that the support member is disposed in a substantially vertical hanging position upon the wall. The opening 44 can take the form of, for example, an angled notch (as shown in FIG. 2), a hook-like opening, or a hole. The main qualification for the opening is that it should securely engage a coupling device while the jig is in the hanging position and disengage the coupling device through application of an upward force on the support member (preferably the bottom end) as indicated by arrow B. In other words, by lifting the jig, the opening should disengage the coupling device and allow the jig to slide free from behind the object being mounted. Thus, the coupling device that was used to hang the jig is covered or concealed by the object itself.

Preferably, the platform member 26 is made of rigid but lightweight material, such as aluminum, and is wide enough to support and balance an object thereon. The brace member 32 and support member 20 also are preferably made of metal, such as aluminum or steel.

Figure 3:
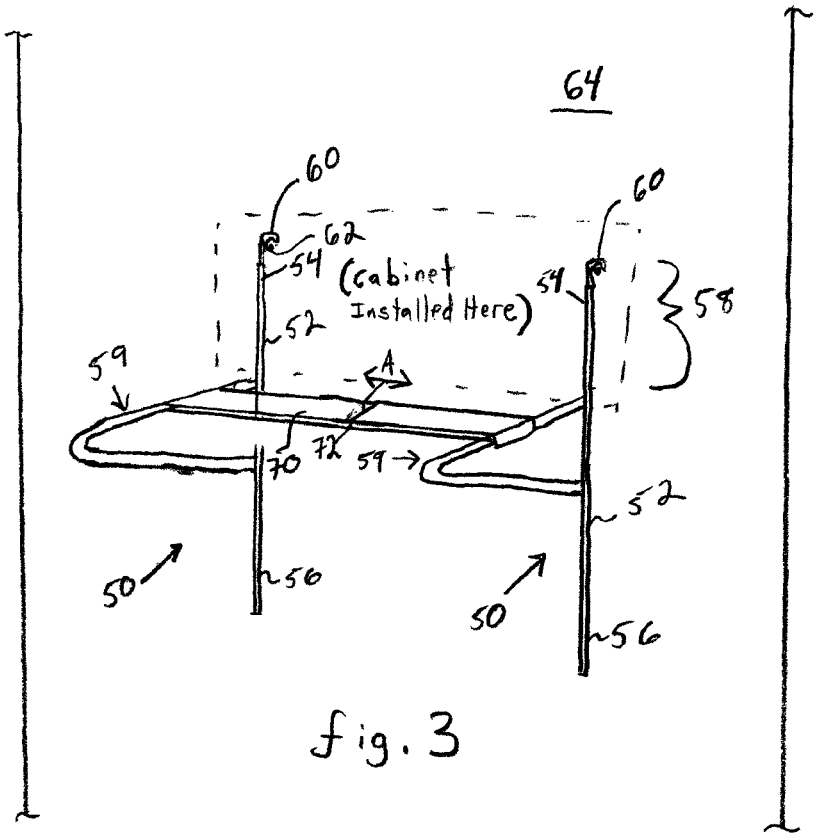
FIG. 3 is perspective view of a kit embodiment of the invention.

Turning to a kit embodiment of the invention as shown in FIG. 3, a plurality of jigs 50 are provided. Each of the jigs 50 includes a support member 52 having a top end 54 and a bottom end 56, wherein a portion 58 of the top end 54 is adapted to be positioned behind a wall-facing surface (as in FIG. 1) of the object being installed, and a platform member 59 coupled to, and extending perpendicularly from, the support member 52. The portion 58 includes an opening (such as hook 60) that is adapted to removably engage a coupling device 62 on or in the wall 64 such that the support member 52 is disposed in a substantially vertical hanging position upon wall 64.

Preferably, the kit further includes a slat 70 adapted to engage at least a pair of jigs 50 to thereby form a bridge there between for supporting the object. Also preferably, the slat 70 is adjustable in length (indicated by arrow A) to accommodate a variety of distances between jigs 50. Length adjustability may be imparted in many ways. For example, the slat 70 may comprise two pieces that are nested together at a junction 72. In other words, the slat 70 extends or retracts by sliding the two pieces in or out.

Figure 4:
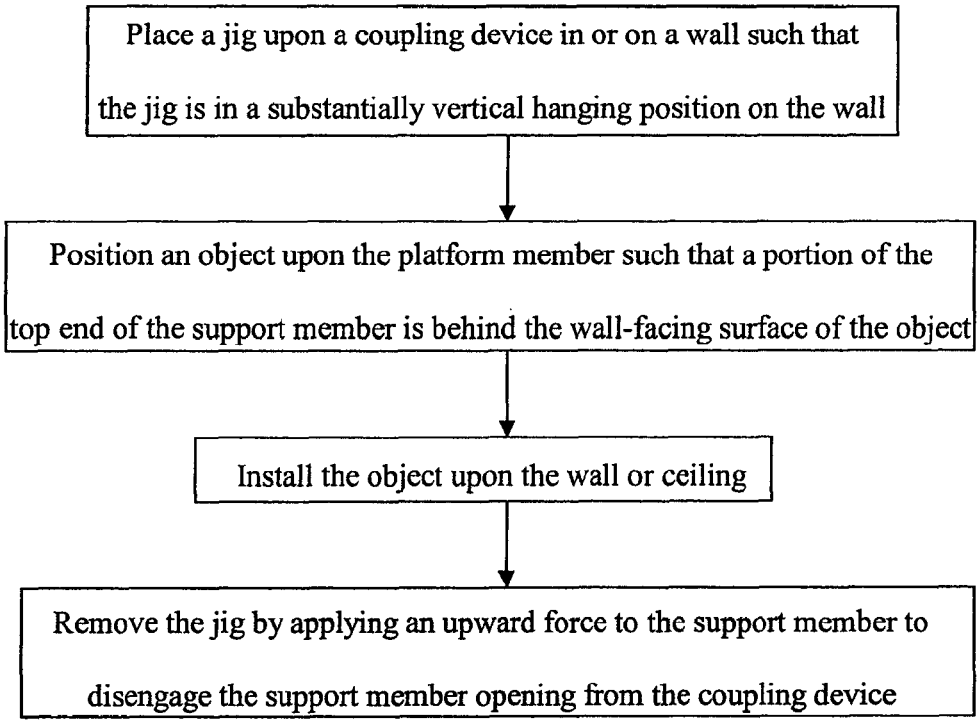
FIG. 4 illustrates in flow diagram the basic steps of a method of the invention.

As shown in simplified outline in the flow chart of FIG. 4, the method for hanging or installing an object upon a wall or ceiling includes the steps of: (a) placing a jig upon a coupling device (through the jig opening) in or on a wall such that the jig is in a substantially vertical hanging position on the wall; (b) positioning the object upon the platform member such that the portion of the top end of the support member is behind the wall-facing surface of the object; (c) installing the object upon the wall or ceiling; and (d) removing the jig by applying an upward force to the support member to disengage the opening from the coupling device.

Of course, the jig of the method may include a brace member that is fixedly attached or positionally adjustable along the support member, as well as other structural features as illustrated in the embodiments above.

Preferably, the platform member and brace member (if one is present) are lowered prior to step (d) to facilitate the application of upward force on the support member, and, thus, disengagement of the jig from the coupling member.

Various changes in the details and components that have been described may be made by those skilled in the art within the principles and scope of the invention herein described in the specification and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

What is claimed is:

1. An article for holding an object in place on a wall, comprising:

a support member having a top end and a bottom end, wherein a portion of the top end is adapted to be positioned behind a wall-facing surface of said object, said portion including an opening that is adapted to removably engage a coupling device on or in said wall such that the support member is disposed in a substantially vertical hanging position upon said wall;

a platform member coupled to, and extending perpendicularly from, the support member; and a brace member that forms a triangle by connecting a lower side of said platform member to said support member, wherein said brace member is hingedly connected to said platform member, and both said platform member and said brace member are positionally adjustable along the support member through slides that move along a track in the support member, and wherein a fastener or turn knob releasably locks said platform member and brace member in a position.

2. A kit for installing an object in place on a wall, comprising:

a plurality of jigs, each of said jigs including a support member having a top end and a bottom end, wherein a portion of the top end is adapted to be positioned behind a wall-facing surface of said object, said portion including an opening that is adapted to removably engage a coupling device on or in said wall such that the support member is disposed in a substantially vertical hanging position upon said wall, a platform member coupled to, and extending perpendicularly from, the support member, and a brace member that forms a triangle by connecting a lower side of said platform member to said support member, wherein said brace member is hingedly connected to said platform member, and both said platform member and said brace member are positionally adjustable along the support member through slides that move along a track in the support member, and wherein a fastener or turn knob releasably locks said platform member and brace member in a position.

3. The kit of claim 2, further including a slat adapted to engage at least a pair of jigs to thereby form a bridge therebetween for supporting said object.

4. The kit of claim 3, wherein said slat is adjustable in length.

* * * * *